United States Patent [19]

Goodrich

[11] Patent Number: 4,828,267

[45] Date of Patent: May 9, 1989

[54] PUTTING PRACTICING DEVICE

[76] Inventor: Ray Goodrich, 2492 W. 12420 South, Riverton, Utah 84065

[21] Appl. No.: 141,595

[22] Filed: Jan. 7, 1988

[51] Int. Cl.[4] ..... A63B 69/36

[52] U.S. Cl. ..... 273/176 F; 273/176 B; 273/178 R; 273/179 C; 273/181 A; 273/182 R; 273/183 A; 273/184 A; 273/185 R; 273/186 C

[58] Field of Search ..... 273/176 B, 176 F, 176 FA, 273/176 FB, 177 R, 178 R, 179 R, 179 A, 179 B, 179 C, 179 D, 181 R, 181 A, 182 R, 183 A, 184 A, 185 R, 186 R, 186 B, 186 C, 192

[56] References Cited

U.S. PATENT DOCUMENTS

| | | | |
|---|---|---|---|
| D. 202,792 | 11/1965 | Draper | 273/176 F X |
| 1,442,054 | 1/1923 | Dixon | 273/182 R X |
| 2,144,439 | 1/1939 | Duffy | 273/176 F |
| 3,424,463 | 1/1969 | Mathews | 273/176 F |
| 3,526,405 | 9/1970 | Morris | 273/176 F |
| 3,762,718 | 10/1973 | Culley . | |
| 4,344,624 | 8/1982 | Laursen | 273/176 F |

FOREIGN PATENT DOCUMENTS

| | | | |
|---|---|---|---|
| 448839 | 4/1968 | Switzerland | 273/176 F |

*Primary Examiner*—Robert E. Garrett
*Assistant Examiner*—M. Williamson
*Attorney, Agent, or Firm*—Trask, Britt & Rossa

[57] ABSTRACT

A golf practicing device is provided having a track having a dual-sided guide with a putting end and a goal end. The track is configured to gravitationally channel the ball along the track when less than a preselected amount of lateral force is applied to the ball. A ramp is associated with the goal end of the track and a series of longitudinally aligned cups are mounted in a goal box. The dual-sided guide may preferably be a longitudinally aligned groove having a circular-arc-shaped cross section which may have a radius approximately the same as a standard golf ball.

19 Claims, 3 Drawing Sheets

PUTTING PRACTICING DEVICE

BACKGROUND OF THE INVENTION

Field: The present invention is directed to sporting equipment and is more particularly directed to a training device to train golfers to putt more accurately..

Prior Art: Many golfers are quite proficient at getting the golf ball from "tee to green." What often separates the pro from the near pro is the ability to putt well. Among those who know how to "read the green," the winners are the ones who can physically make the ball go where they want it to go. In other words, many golfers can look at a ball lying on a green and know in which direction and with what amount of relative force the ball should be driven to sink the putt. However, their problem lies in their lack of physical ability to strike the ball properly with the putter.

It is important to be mentally educated in the art of putting. However, the only way a golfer can become a proficient putter is to train his muscles to "remember" the precise movements needed to cause the ball to go where his mind knows it needs to go. This training of the muscles is referred to as "muscle memory."

Of course, golfing itself is one form of muscle training. Also commonly known are simple putting cups, usable, for example, on floor surfaces such as carpet. Some of these cups have automatic return devices, in which for example, a battery powered mechanism knocks the balls back to the golfer if he correctly sinks the put.

Another putting practicing device is the "Putting Tutor" sold by Putting Tutor of Boise, Idaho, which is represented to be covered by U.S. Pat. No. 3,762,718. This device apparently has a ramped slope with a hole in it. The angle of the ramp can be reoriented. The golfer attempts to gauge the slope of the ramp and putts the ball similar to the way he would on a normal green.

The mentioned types of golf practicing devices have not been totally satisfactory. A golf ball does not react the same way on a floor surface, such as carpet, as it would on a green. In addition, artificial slopes do not precisely simulate the natural slopes and curvatures of natural green.

In addition, the golfer may have failed to mentally visualize the intended and correct direction of travel. The successful putt may have been a result of putting in the general right direction. If the golfer's mind has not, prior to putting the ball, actually visualized a line of travel, it is questionable whether any effective muscle memory has occurred. In order to improve putting ability, the mind and the muscles must coordinate to duplicate the motions learned from previous successful putts.

Even on a natural green, the golfer does not have an instant feedback as to whether he has struck the ball precisely in the intended direction. He must wait to see if the ball goes in the hole. By the time the golfer's mind has registered that a putt has been sunk, his muscles may have forgotten the precise movements they made to drive the ball in the intended direction.

The real need is for a device which will induce the golfer to visualize for each practice putt the intended putting direction and to give instant feedback to the golfer when he has driven the ball in any direction other than the visualized and intended direction.

SUMMARY OF THE INVENTION

The present invention provides a putting practicing device for use with a golf club and golf balls, and which is intended to train the golfer to, prior to putting the ball, visualize the intended putting direction and to consistently and accurately putt the golf ball in the desired direction and in the absence of undesired spin characteristics. This golf practicing device comprises a track, which has a guide having a pair of longitudinally aligned sides. The sides are laterally spaced to register with and gravitationally channel a golf ball along the track. The guide has sufficient dimensions to retain the ball along the track when putted from a putting end of the track to a goal end when less than a preselected amount of lateral force is exerted on the golf balls. The track also serves as a visual tool to cause the golfer to coordinate muscle memory to the envisioned and intended direction of ball travel—along the track. At least one cup is mounted with respect to the goal end of the track to receive the balls after they leave the goal end of the track.

In a preferred embodiment, the golf practicing device may also include a ramping means in association with the goal end of the track to elevate the goal end of the track. When balls are putted along the track from the putting end to the goal end, the elevated goal end causes the balls to be launched from the goal end with an upwardly angling trajectory. The cups are mounted longitudinally in line with the track to receive the balls after they are launched from the goal end of the track when the balls have been correctly putted with a preselected amount of force.

The guide may have a pair of upper ridges which are laterally spaced to register with and guide the balls. The guide may be formed of a groove running the length of the track. The upper edges of such a groove, whether circular-arc-shaped or otherwise, may form such a pair of ridges. It is believed that the most preferred embodiment is one in which the radius of the circular-arc-shaped groove is approximately the same as the radius of standard golf balls.

The cups are preferably mounted in a goal box which has a back stop and side guards to preclude golf balls from going beyond or off the sides of the goal box when the balls do not land in one of the cups. The golf practicing device may also preferably have a return guide or a plurality of return guides in association with the cups to receive balls from the cups, after they have been correctly putted into one of the cups. The return guides return the balls to a deposit station from which the golfer can conveniently retrieve them. Each cup may have a respective return guide with its respective deposit station. The respective cups and return guides may be preferably color matched to coordinate with a plurality of respective colored sets of golf balls.

BRIEF DESCRIPTION OF THE DRAWINGS

In the drawings, which illustrate what is currently regarded as the best mode for carrying out the invention.

DETAILED DESCRIPTION OF THE PREFERRED EMBODIMENT

Figures 1, 2, 3, 3A:
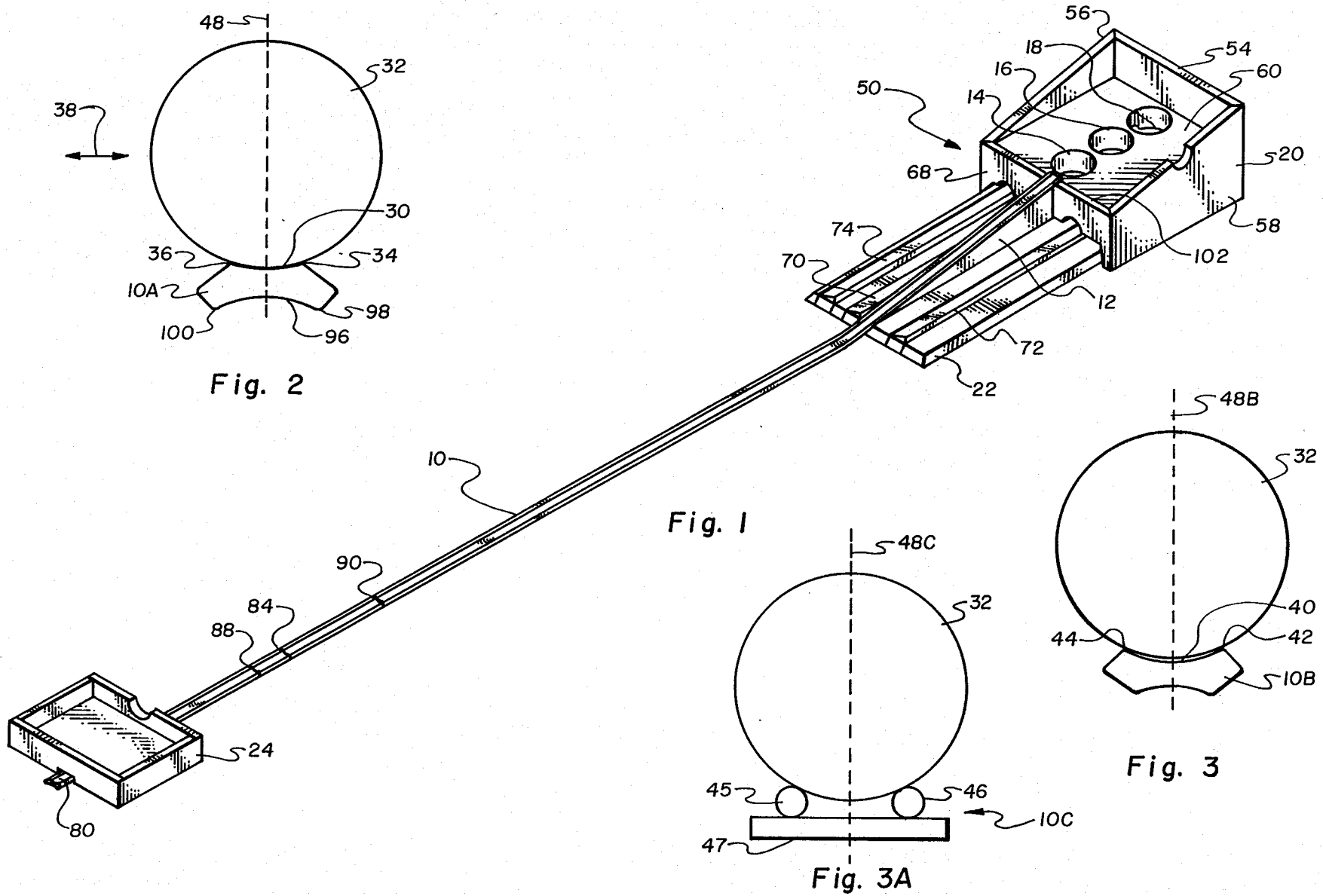
FIG. 1 is a perspective view of a golf practicing device of the invention.
FIG. 2 is a cross sectional view of a golf ball upon a track of the invention.
FIG. 3 is a cross sectional view of a golf ball upon an alternative embodiment of a track of the invention.
FIG. 3A is a cross sectional view of another alternative embodiment of a track of the invention.

As shown in FIG. 1, a golf practicing device of the invention includes a track 10, a ramp 12, a plurality of cups 14, 16, 18, a goal box 20, a goal base 22, and a holding box 24. Golf balls are placed upon track 10, and are putted toward goal box 20 so as to cause the golf ball to go up track 10 on ramp 12 and into one of the plurality of holes 14, 16, or 18. A more particular description of the use of the golf practicing device of FIG. 1 will be given hereafter.

FIGS. 2, 3, and 3A illustrate three alternative embodiments of track 10 of FIG. 1, and are therefore labeled tracks 10A, 10B, and 10C, respectively. Referring to FIG. 2, track 10A has a circular-arc-shaped groove 30 which registers with golf ball 32. As shown, groove 30 has approximately the same radius as golf ball 32. The upper edges 34 and 36 of track 10A constitute a pair of ridges to guide golf ball 32 and to preclude golf ball 32 from leaving track 10A when less than a preselected amount of lateral force is applied to golf ball 32. Lateral force means force exerted in the direction of the sides of ball 32, i.e., in either direction indicated by the double arrow 38.

Referring to FIG. 3, track 10B has a circular-arc-shaped groove 40 which has a radius smaller than that of golf ball 32. The edges 42 and 44 of groove 40 comprise a pair of ridges which register with and guide ball 32 to preclude ball 32 from leaving track 10B when less than a preselected amount of lateral force is exerted upon ball 32. Referring to FIG. 3A, track 10C has a pair of cylindrical rods 45 and 46 which function as a pair of ridges to guide and channel ball 32 along track 10. Rods 45 and 46 are firmly mounted, for example with fasteners or glue, to rectangular base 47.

Each of the tracks, 10A, 10B, and 10C has a pair of longitudinally aligned sides which continuously register with and gravitationally channel ball 32 along track 10. In FIG. 2, the two sides are comprised of the two half-sections of arc 30 which lie on either side of center line 48. In FIGS. 3 and 3A, the two sides of tracks 10B and 10C lie on either side of center lines 48B and 48C, respectively.

Referring now again to FIG. 1, track 10 is connected to ramp 12. As better seen in FIG. 4, ramp 12 is a generally triangular piece attached between track 10 and goal base 22 to elevate the goal end 50 of track 10 and to cause track 10 to angle upward at its goal end 50. Track 10 may be connected to ramp 12 by any of several convenient methods, including, for example, metal fasteners or glue. It may be preferable for track 10 to be connected to ramp 12 by means of a removable metal fastener, such as a screw, so that the golf practicing device of FIG. 1 may be conveniently disassembled for storage or transport. Such disassembly will be more fully described hereafter.

Goal box 20 houses a plurality of cups 14, 16 and 18, into which a golfer may attempt to putt a golf ball. Goal box 20 is shown to have a generally box-shaped structure with a back board 54 and a pair of side guards 56 and 58. A generally horizontal shelf 60 is provided in goal box 20 to which are attached cups, 14, 16 and 18.

Cups 14, 16 and 18 are connected to shelf 60 by being cemented or otherwise connected in holes formed in shelf 60. Cups 14, 16 and 18 extend below shelf 60, as more easily visible in FIG. 4. Cups 14, 16 and 18 are generally cylindrical pieces, each having a U-shaped notch 62, 64 and 66, respectively, as best seen in FIGS. 4 and 5.

Figure 4:
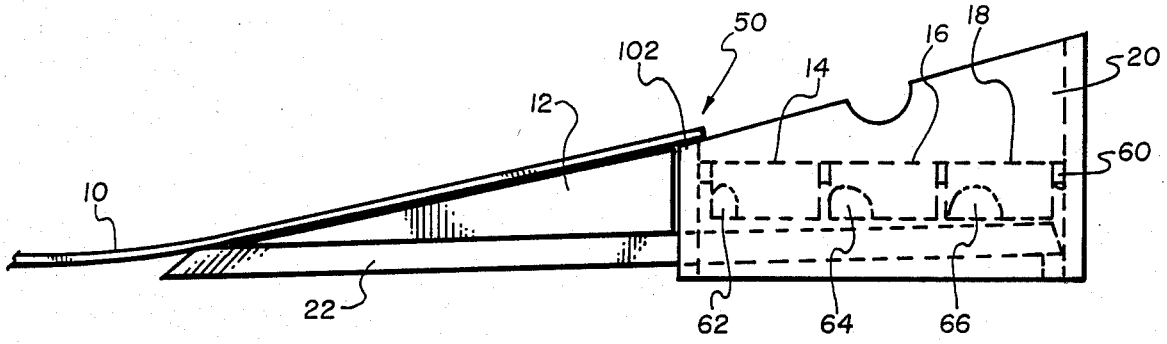
FIG. 4 is a side, partial phantom, view of the ramp and goal box assembly of FIG. 1.

Goal base 22 associates with goal box 20 as shown in FIG. 4. Goal box 20 is adapted to be removably attached to goal base 22. As shown in FIG. 1, goal box 20 has a front face 68 which is notched to allow goal base 22 to slide into goal box 20, and to be under and associating with cups 62, 64 and 66, as shown in FIGS. 4 and 5.

Figure 5:
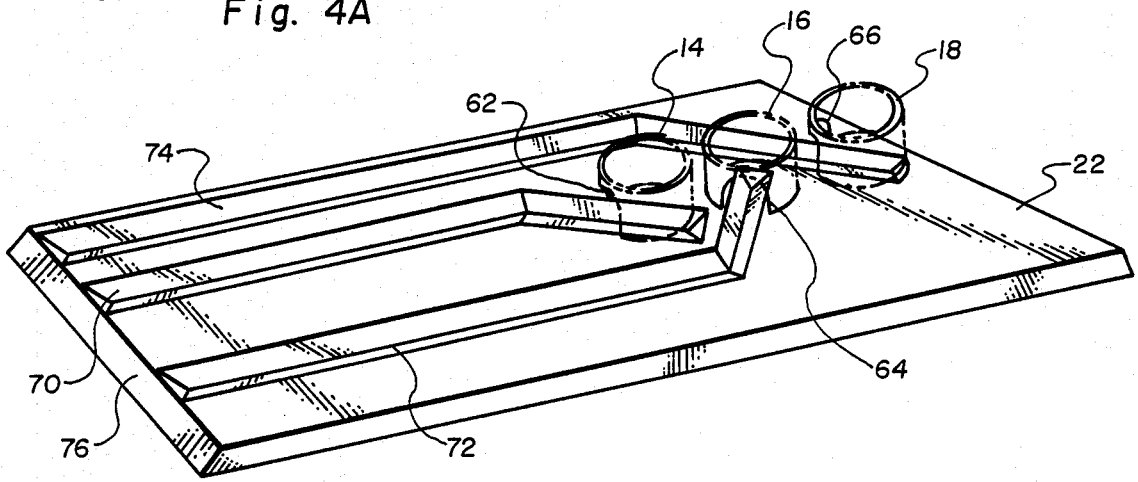
FIG. 5 is a perspective, partial phantom, view of the cup and goal base assembly of FIG. 1.

In FIG. 5, cups 14, 16 and 18 are shown in their positions to register with grooves 70, 72 and 74 which are formed in goal base 22. Horizontal shelf 60, to which cups 14, 16 and 18 are connected, is not shown in order to more clearly illustrate the association between cups 14, 16 and 18 and groove 70, 72 and 74. Grooves 70, 72 and 74 have a generally triangular shaped cross section and extend to register with cups 14, 16 and 18, respectively, as shown. Grooves 70, 72 and 74 are formed to have a smaller triangular cross section at the point where they associate with cups 14, 16 and 18, respectively, and have a gradually increasing cross-sectional size as the grooves approach the front end 76 of goal base 22. A golf ball placed in one of the cups 14, 16 or 18 falls into a groove 70, 72 or 74, respectively, and passes through a notch 62, 64 or 66, respectively. Because of the gradually increasing cross section of the grooves 70, 72, and 74, the ball gravitationally settles and rolls toward front end 76 of goal base 22. The front end 76 of goal base 22 therefore constitutes a deposit station for golf balls after they have been successfully putted into one of cups 14, 16 or 18, respectively. Each of the grooves, 70, 72 and 74, near the front end 76 of goal base 22, therefore, also serves as a deposit station for golf balls.

Referring now again to FIG. 1, box 24 serves as a container for balls which the golfer intends to golf along track 10. Box 24 has a rectangular notch 80, sized to register with track 10.

Preferably, cups 14, 16 and 18 are of different colors to coordinate with different colored golf balls to be putted into cups 14, 16 and 18. For example, cup 14 may be orange, cup 16 may be yellow and cup 18 may be white. The golfer may then have three golf balls for each cup, in other words, three orange balls, three yellow balls and three white balls. The game object would be to golf all of the three orange balls up the track into the orange cup, the three yellow balls into the yellow cup and the three white balls into the white cup. Groove 70 is preferably colored the same as cup 14, groove 72 colored the same as cup 16, and groove 74 colored the same as 18.

If the golfer putts the balls correctly into their respective cups, each groove, near front end 76, of base 22, will contain three balls of the same color as its respective groove. If the golfer fails to putt the balls correctly into their respectively colored cups, grooves of one color will contain balls of other colors. In addition, some grooves may have more or less than their respective three balls. The golfer thus has a way of determining his relative performance without having to remember which balls he putted into which cups. A numeric score may also be thus tabulated based on the number of balls putted into their respectively colored cups.

Figure 6:
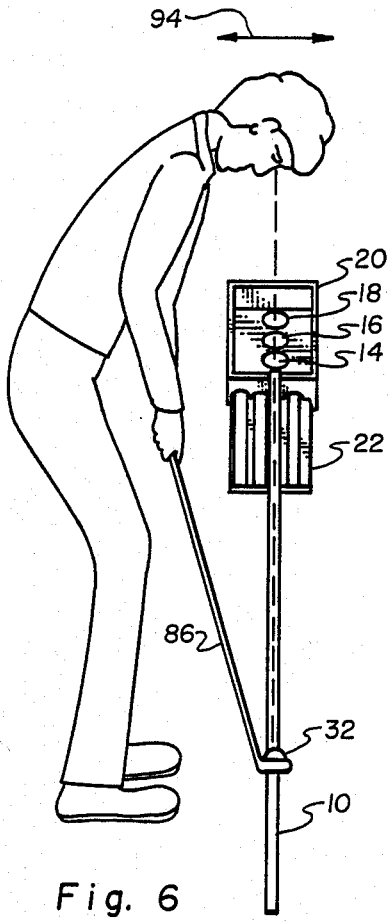
FIG. 6 is a longitudinal view of a golfer using the putting practicing device of FIG. 1.
Figure 7:
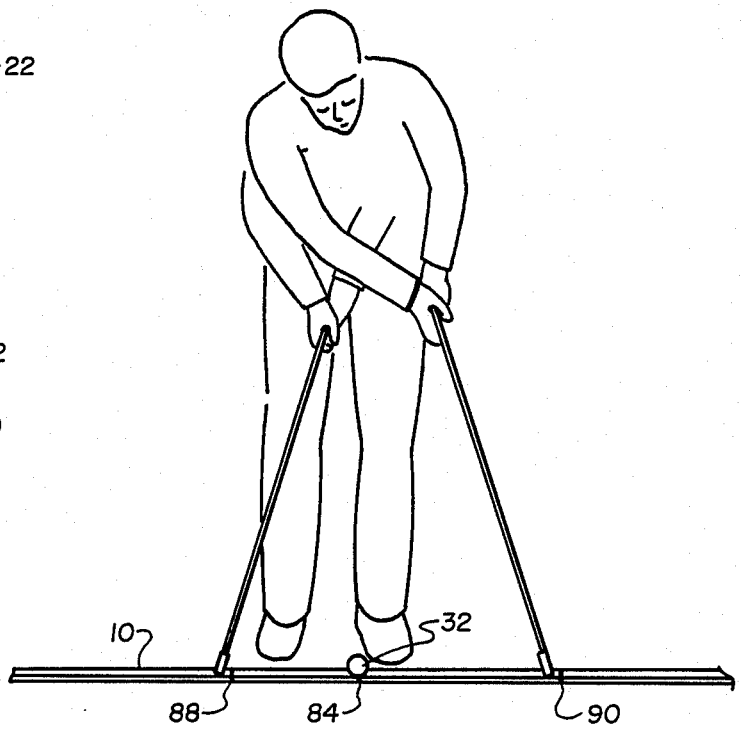
FIG. 7 is a side view of a golfer using the putting practicing device of FIG. 1.

In use, the golfer stands as shown in FIGS. 6 and 7 with his feet slightly apart next to track 10. The ball should be straight out from the left heel of the golfer as shown in FIG. 7. The golfer should keep his weight evenly balanced over both feet. In addition, the golfer's eyes should be directly over the track, so that if a ball were to be held at the eyes and dropped, it would land on the track. A mark 84 is placed on track 10 to give the golfer guidance as to where he should place himself and the ball longitudinally along track 10.

The golfer should use the track to form a mental image of the proper and intended direction of travel. A correlation between the mental image of the intended direction of travel and the physical movements engaged in during a successful putt aid in desirable "muscle memory." It may, therefore, be particularly advantageous for track 10 to have a line painted longitudinally down the center to aid the golfer in visualizing where the ball will travel if it is putted correctly.

The golfer, holding putter 86, as shown, with both hands, preferably makes a back stroke, as shown in FIG. 7 to mark 88 on track 10. As also shown in FIG. 7, the golfer then makes a forward stroke "through the ball" to mark 90 on track 10. The golfer may vary the stroke to increase or decrease the distance the ball is putted to putt the ball into the desired cup.

Figure 8:
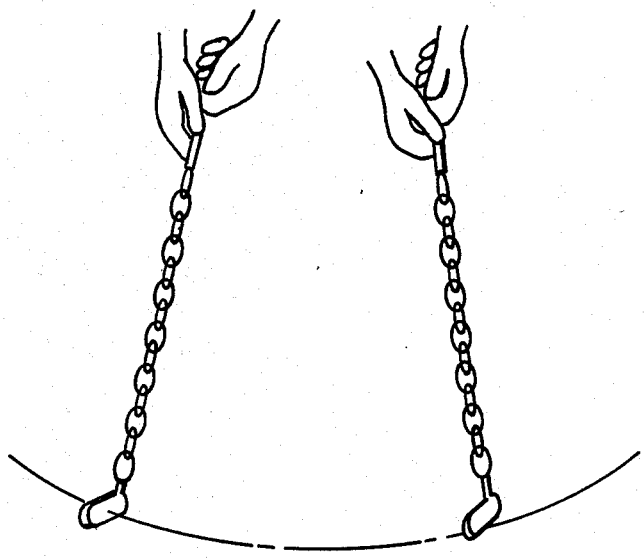
FIG. 8 is a side schematic illustration of the pendulum principle of golfing.

The golfer should stroke back and forward rhythmically, back slowly, then accelerate through the ball with only his arms moving the putter, as shown in FIG. 7. The golfer should maintain a constant grip pressure throughout the stroke. The golfer should swing the putter as though it were a weight on the end of a chain, as depicted in FIG. 8. The golfer should visualize swinging the chain back and forth without allowing the chain to buckle as he changes from the back stroke to the forward stroke. This visualization is referred to as the pendulum principle.

Referring to FIG. 6, if the ball is putted with greater than a preselected amount of lateral force, in other words, force in either direction indicated by double arrow 94, the ball 32 will leave the track 10. As indicated before, track 10 is configured to gravitationally channel ball 32 along track 10 when less than a preselected amount of lateral force is exerted on ball 32. If the golfer is not careful to hit the ball straight, or if the golfer delivers more than a pre-selected amount of spin to ball 32, the ball will naturally leave track 10. Track 10 is by nature dual-sided. If force is exerted in either of the lateral directions in greater amounts than the preselected amount, the ball with leave that respective side.

It is also important that the golfer strike the ball in the appropriate position in the vertical direction. Obviously, if the golfer strikes the ball too low, he may cause the ball to hop up off the track or may deliver an upward component of momentum to the ball making it easier for the ball to leave the track laterally, thus reducing the amount of lateral force needed to drive the ball from the track. Ideally, the golfer will putt the ball slightly above the center of gravity of the ball.

It is believed that the best form of track 10 is one in which the dual-sided guide such as groove 30 in FIG. 2, has a circular-arc-shaped cross section having a radius the same as that of a golf ball. Standard golf balls have a diameter of 1 and $\frac{5}{8}$ths inch, in other words, a radius of 13/16ths of an inch. It is believed that a track groove radius being the same as a golf ball provides the best characteristics for retaining the ball on the track when the proper stroke is delivered and for causing the ball to leave the track when an improper stroke is delivered to the ball. It is believed that with the guide having a cross-sectional radius approximately equal to that of a golf ball, the ball will leave the track if improper spin is delivered to the ball. If the ball is spinning, it will typically frictionally register with the curved sides of the track to spin itself out of the groove and off the track. It is also believed that an arc length of approximately $\frac{1}{2}$ inch between the edges, such as edges 34 and 36 of the arc-shaped groove is preferable.

If a somewhat easier practice is desired, track 10A may be reversed so that circular-arc-shaped groove 96 faces upward to register with ball 32. Groove 96, also forming a dual-sided guide, also has a radius approximately the same as a golf ball, but a greater arc length, i.e., the length between edges 98 and 100. Using the groove 96 would increase the pre-selected amount of lateral force needed to cause ball 32 to leave track 10.

Figure 4A:
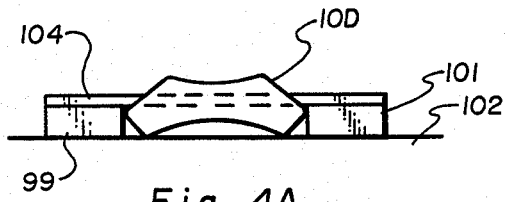
FIG. 4A is a cross sectional view of an attachment means for attaching a track to a goal box of the invention.

FIG. 4A illustrates a fastening system for a track 10D (shown to be similar to track 10A). This fastening system includes a pair of permanent magnets 99 and 101 firmly attached to the front face 102 of goal box 20. A cylindrical metal rod 104 passes through and is firmly attached to track 10D as shown. Track 10D is thus effectively attached to goal box 20 and may be conveniently removed and reversed to change the difficulty or characteristics of the putting device.

As shown in FIG. 3, it may be preferable for the arc-shaped groove, such as arc-shaped groove 40, to have a radius smaller than that of a golf ball, of which ball 32 is typical. In FIG. 3, edges 42 and 44 constitute a pair of ridges upon which ball 32 rolls to guide ball 32 along track 10B. Groove 40 may have a shape other than circular-arc-shape, inasmuch as the inner shape of groove 40 does not effect the association between ball 32 and edges 42 and 44. Certain embodiments of track 10 may have a groove with circular-arc-shaped cross section with a radius greater than that of a golf ball, allowing golf ball 32 to roll laterally a small distance within the track before leaving the track. However, it is currently believed that such embodiments are not preferred.

All of the embodiments of a track discussed are "dual-sided" and provide a means for gravitationally holding a golf ball onto the track when less than a preselected amount of lateral force is applied to the ball. Lateral force may be applied directly from the putter to the ball upon the stroke of the ball or may be applied upon the ball by the track itself when undesirable spin is delivered to the ball.

The illustrated embodiments have two longitudinally aligned sides which continuously register with and gravitationally channel a golf ball along the track. The gravitational channeling is due to the cross-sectional dimensions of the track. To fly off the sides of the track, the ball must move up and out of its position of lower relative gravitational potential energy with respect to the "ridges" of the track. Relative gravitational potential energy of the ball is a function of the mass of the ball. A standard golf ball weighs about 55 grams.

The preselected amount of lateral force required to cause the ball to leave the sides of the track is largely dependent on the lateral distance between the ridges of the track. In FIG. 2, edges 34 and 36 constitute such ridges. In FIG. 3A, rods 45 and 46 constitute the ridges.

It is currently believed that the preferred distance between the ridges is about ½ inch. However, depending on the difficulty of practice desired and the characteristics of the "groove," the distance can be as little as ⅜ inch, although this distance provides a very difficult practice. It is currently believed that a distance between ridges greater than about one inch provides a practice which is too easy for effective putting practice. In the embodiment of FIG. 2, radius 30 has an arc length of ½ inch, and radius 96 has an arc length of ¾ inch.

Referring to FIG. 1, track 10 is approximately 8 feet long. The distance between mark 84 and the goal end 50 is approximately 6½ feet. Mark 88 is preferably about 6 inches from mark 84, although this distance may be increased to about as much as ten inches. Mark 90 is about 12 inches from mark 84, although this distance can be increased to about 18 inches. Ramp 12 is about 18 inches long and about 5¾ inches at its highest point.

Cups 14, 16 and 18 are about 4½ inches in diameter. A preferred range of diameter of cups 14, 16 and 18 is between about 3 inches to about 4½ inches. Cups 14, 16 and 18 are spaced about ¾ inch away from each other. Cup 14 is spaced about one inch from the goal end 50 of track 10, and cup 18 is spaced about one inch from back board 54. Cups 14, 16 and 18 are about 2½ inches high. Goal box 20 is about 11 inches wide between side guards 56 and 58 and about 17 inches in length between front face 68 and back board 54.

The golf practicing device of FIG. 1 is adapted to be disassembled in order to be easily transported or stored. Track 10 may be removed from ramp 12 and coiled up. Track 10 may be formed of wood or an appropriate flexible material such as polyethylene or nylon. It has been found that tracks formed of polyethylene perform particularly well because of the shape-retaining characteristics of polyethylene. Goal box 20 and goal base 22 may be preferably made of wood. As indicated earlier, goal base 22 may be disassembled from goal box 20. Box 24 may be simply lifted from track 10. After track 10 has been coiled for storage or transport, box 24 may aid in holding track 10 flat for use. In addition, track 10 may be formed to be sectionalized to be taken apart or reassembled in a plurality of longitudinal sections. Track 10D may be particularly and advantageously adapted to such sectionalization.

In certain applications it may be preferable for the golf practicing device of FIG. 10 to be securely mounted to a support surface such as a large flat board or to a floor in order to prevent lateral distortions of track 10. It is important that the track 10 retain its straight longitudinal characteristics. Bending or twisting of track 10 may be advantageously avoided by mounting the entire assembly in a permanent manner.

Reference herein to details of the illustrated embodiment is not intended to restrict the scope of the appended claims, which themselves recite those features regarded as important to the invention.

I claim

1. A golf practicing device for use with a golf club and golf balls, said golf practicing device comprising:

a track having a guide comprised of a pair of longitudinally aligned sides laterally spaced to continuously register with and gravitationally channel a golf ball along said track when less than a preselected amount of lateral force is exerted upon said balls, said track having a goal end; and at least one cup mounted with respect to said goal end of said track to receive a said ball from said goal end of said track.

2. A golf practicing device according to claim 1 further comprising a ramping means in association with said track for elevating said goal end of said track.

3. A golf practicing device according to claim 1, wherein said guide is a groove running the length of said track.

4. A golf practicing device according to claim 1, wherein said guide is comprised of a pair of ridges laterally spaced to continuously register with said balls.

5. A golf practicing device for use with golf balls and a golf club, comprising:

a track having a guide comprised of a pair of longitudinally aligned sides laterally spaced to continuously register with and gravitationally channel golf balls along said track from a putting end to a goal end of said track when less than a preselected amount of lateral force is exerted upon said balls;

a ramp in association with said goal end of said track to angle said goal end of said track upward of said putting end, whereby when balls are putted from said putting end to said goal end, said balls are launched from said goal end with an upwardly angling trajectory; and a plurality of cups mounted with respect to said goal end of said track to receive balls from said goal end of said track after being putted along said track with a preselected amount of longitudinal force.

6. A golf practicing device according to claim 5, wherein said dual-sided guide is formed of a groove running the length of said track.

7. A golf practicing device according to claim 6, wherein said groove has a circular-arc-shaped cross section.

8. A golf practicing device according to claim 6, wherein said circular-arc-shaped cross section has a radius approximately equal to the radius of a golf ball.

9. A golf practicing device according to claim 5, wherein said cups are mounted in a goal box having a back stop and side guards.

10. A golf practicing device according to claim 9, further comprising a plurality of goal guides associated with said cups to receive balls from said cups and urge said balls toward a deposit station associated with said goal guides.

11. A golf practicing device for use with a golf ball and a golf club, comprising:

a track having a guide comprised of a pair of longitudinally aligned sides laterally spaced to continuously register with and gravitationally channel a golf ball along said track from a putting end to a goal end of said track and to preclude said balls from leaving said track when less than a preselected amount of lateral force is exerted upon said balls;

a ramp device associated with said goal end of said track to elevate said goal end, whereby said golf balls are launched from said goal end with an upwardly angling trajectory when said balls are putted from said putting end to said goal end;

a plurality of cups mounted with respect to and longitudinally aligned with said track and spaced from said goal end to receive said balls from said goal end when said balls are putted along said track with a preselected amount of longitudinal force.

12. A golf practicing device according to claim 11, wherein said guide is a groove running the length of said track.

13. A golf practicing device according to claim 12, wherein said groove has a circular-arc-shaped cross section.

14. A golf practicing device according to claim 13, wherein said groove has a radius approximately equal to the radius of a golf ball.

15. A golf practicing device according to claim 11, further comprising a plurality of return guides associated respectively with said plurality of cups to receive said balls from said cups and to urge balls to a deposit station associated with said return guides.

16. A golf practicing device according to claim 15, wherein each of said plurality of return guides is color-matched to a respective associated colored cup.

17. A golf practicing device according to claim 11, wherein said track has two of said guides on said track and wherein either of said guides may be selectively positioned for use.

18. A golf practicing device according to claim 11, wherein said track is detachably associated by attachment means with said plurality of cups.

19. A golf practicing device according to claim 18, wherein said attachment means includes a magnet.

* * * * *